United States Patent [19]

Oligschlaeger

[11] Patent Number: 4,979,309

[45] Date of Patent: Dec. 25, 1990

[54] ARCHERY BOW SIGHT

[76] Inventor: Maurice L. Oligschlaeger, 401 Independence, Tipton, Mo. 65081

[21] Appl. No.: 489,257

[22] Filed: Mar. 5, 1990

[51] Int. Cl.[5] ..... F41G 1/46

[52] U.S. Cl. ..... 33/265; 124/87

[58] Field of Search ..... 33/265; 124/87; 356/21, 356/22

[56] References Cited

U.S. PATENT DOCUMENTS

| | | | |
|---|---|---|---|
| 4,178,093 | 12/1979 | Smith | 33/265 |
| 4,507,874 | 4/1985 | Brown | 33/265 |
| 4,555,856 | 12/1985 | Brown | 33/265 |

*Primary Examiner*—Harry N. Haroian

*Attorney, Agent, or Firm*—Kokjer, Kircher, Bradley, Wharton, Bowman & Johnson

[57] ABSTRACT

A range finding bow sight for archery bows which includes a frame on which are mounted upper and lower mirrors in a substantially parallel relationship at a 45 degree angle and vertically aligned with each other forwardly of the bow. The top mirror is pivotally mounted and adjustably responsive to manipulation of a lever which cooperates through a programmed cam segment on a rotationally mounted sighting plate to which is attached a sight pin. Movement of the actuating lever correspondingly shifts the upper mirror to permit alignment of the actual target image with a reflected target image from the lower mirror. Movement of the actuating lever simultaneously positions the sight pin to provide the necessary elevation of the bow for the proper trajectory of the arrow to the target. The programmed cam section is removable and can be shaped to match the performance characteristics of the archery equipment being used.

9 Claims, 2 Drawing Sheets

ARCHERY BOW SIGHT

This invention relates to an archery bow sight and, more particularly, the invention relates to an adjustable range finding sight for mounting on an archery bow.

BACKGROUND AND SUMMARY OF THE INVENTION

Mastery of the art of archery is extremely difficult as many variables affect the accurate delivery of an arrow to the archer's desired target. The greatest variable is the accurate estimation of the distance the arrow is to travel to the target. An arrow moves relatively slow and falls to earth at an accelerating rate on its way to the target. This is the nature of archery and the trajectory of the archer's arrows requires extreme accuracy in range estimation by the archer in order to effectively place an arrow in a desired target, usually smaller than a dinner plate. The use of a sight pin in conjunction with a peep sight on the string of a bow can provide this accuracy if the exact range to the target can be ascertained.

Various bow sights have been shown for increasing the archers accuracy. U.S. Pat. No. 2,001,470 issued May 14, 1935 to Nyvall shows a folding bow with a top and bottom mirror acting as a periscope to reflect an image of the target to the eye of the archer. The lower mirror is rotationally articulated to align cross hairs on the lower mirror with the target. The lower mirror must be rotated to pre-arranged positions which relate to various distances which the archer must estimate by other methods.

U.S. Pat. No. 3,163,697 issued Dec. 29, 1964 to White shows a dual spaced mirror device arranged such that the viewer will simultaneously see both a real and a reflected target image. As a viewer looks at the target, a slide is manipulated until real and reflected images are both seen at the same height. At this position the bow is aimed at the target and is properly positioned such that an arrow will assume the proper trajectory to the target.

U.S. Pat. No. 3,524,440 issued Aug. 18, 1970 to Hill shows a mirror sighting device with an upper and lower mirror with cross hairs on one of the mirrors. The lower mirror is focused on the target while the upper mirror is focused on the lower mirror and reflects the target image to the archers eye. The mirror mounting the cross hairs may be adjusted vertically to compensate for distance to the target.

U.S. Pat. No. 2,788,701 issued Apr. 16, 1957 to Browning, shows a device incorporating multiple mirrors mounted below a single upper mirror for reflecting the image of the target and transmitting the image to the eye at various levels to facilitate trajectory adjustment of the bow for delivery of an arrow to the target.

U.S. Pat. No. 4,507,874 issued Apr. 2, 1985 to Brown, shows a bow sight characterized by a periscope device enclosing a top mirror and a bottom mirror to direct an image of a target to the eye of the archer. A compensating mirror is also mounted in the periscope in parallel adjustable relationship with respect to the top and bottom mirrors. A split target image is viewed in the fixed bottom mirror and comparison of this split image facilitates raising the bow to a proper angle in order to compensate for the trajectory of an arrow.

U.S. Pat. No. 4,555,856, issued Dec. 3, 1985 to Brown, is a continuation-in-part of the earlier '874 patent and shows a bow sight which includes, a housing enclosing a bottom mirror, a top mirror mounted in spaced relationship in the housing with respect to the bottom mirror and a narrow compensating mirror positioned in the housing in close proximity to the bottom mirror. The top and bottom mirrors are mounted in substantially parallel relationship at approximately a 45 degree angle in the housing and the top mirror and the compensating mirror are pivotally mounted with the compensating mirror adjustably responsive to manipulation of a lever from a calibrated position. The target image segment projected from the top mirror to the bottom mirror is compared to the target image segment projected from the compensating mirror to the bottom mirror and the lever is moved in order to provide the necessary adjustment to align the segments and determine a proper trajectory for accurately delivering an arrow to the target.

Numerous drawbacks have existed in the reliability and effective use of prior art sighting devices for archery bows. The need remains in the archery industry for a sight readily adaptable for long bows, recurve bows, compound bows, cross bows, and other similar projectile propelling devices of interest, which can accurately determine the distance between the viewer and the target and which can simultaneously adjust a sight pin to the proper trajectory for the arrow to the target. The primary goal of this invention is to fulfill this need.

Another further object of the invention is to provide a bow sight which is applicable to various bows and which uses a fixed bottom mirror and an adjustable top mirror in cooperation with an adjustable sight pin to determine the distance to the target and compensate for the arrow trajectory.

Yet another object of this invention is to provide an improved range finder device cooperating with a sighting device for various bows, which range finder device is characterized by a frame carrying a fixed bottom mirror and an adjustable top mirror pivotally mounted and cooperating with a horizontally moving sight pin whose cooperative movements are controlled by the shape of a programmable cam tangentially mounted on the rotational axis of the movable sight pin and whose design will adjust the arrow trajectory relative to the distance from the archer to the target when the archer views the split image composed of the real image and the reflected image and moves the operating lever which is geared to and cooperates the movable sight pin which also cooperates with the upper mirror adjusting lever. When the images are horizontally aligned the proper programmed cam movement has occurred and the sight pin has been moved to the proper position to deliver an arrow accurately to the target chosen by the archer.

A further object of the invention is to provide a range finder coupled bow sight of the character described and having various programmable cam sections which provide the exact movement between the range finder mirrors and the movable sight pin, which programmable cam is designed using the best known mathematical and geometrical relations and the desired trajectory necessary to accurately aim a bow and deliver an arrow to the desired target. Use of a preselected programmed cam section will therefore allow the archer to match the bow sight characteristics to the particular specifications of the archer's own equipment to accurately aim an arrow at a target within the effective range of the archer's bow.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

Figure 1:
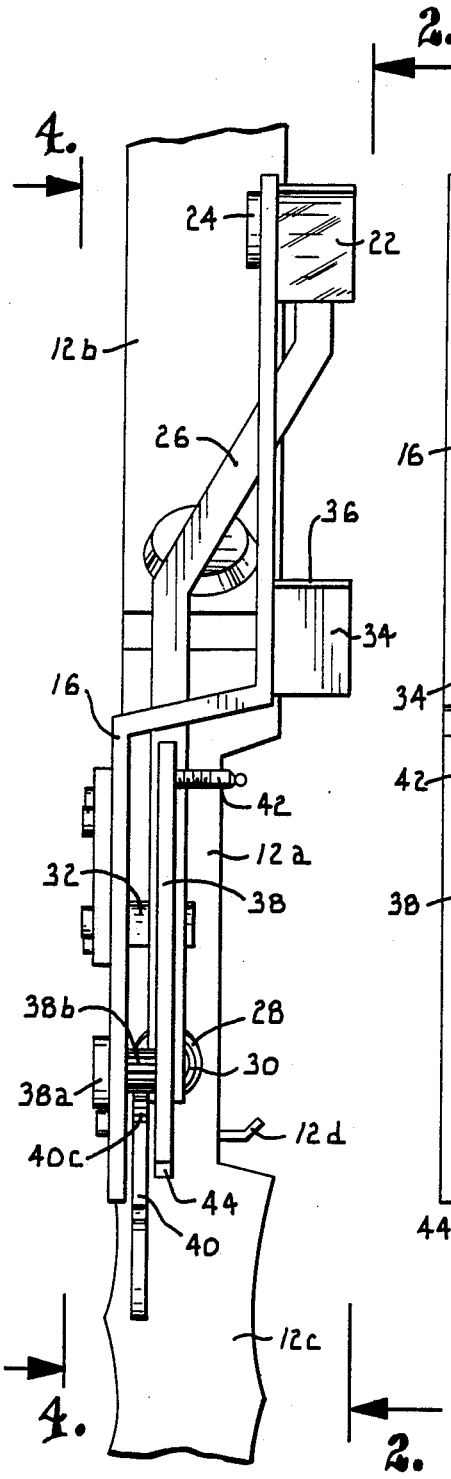
FIG. 1 is a front elevation view of a bow sight constructed in accordance with a preferred embodiment of the invention.
Figure 2:
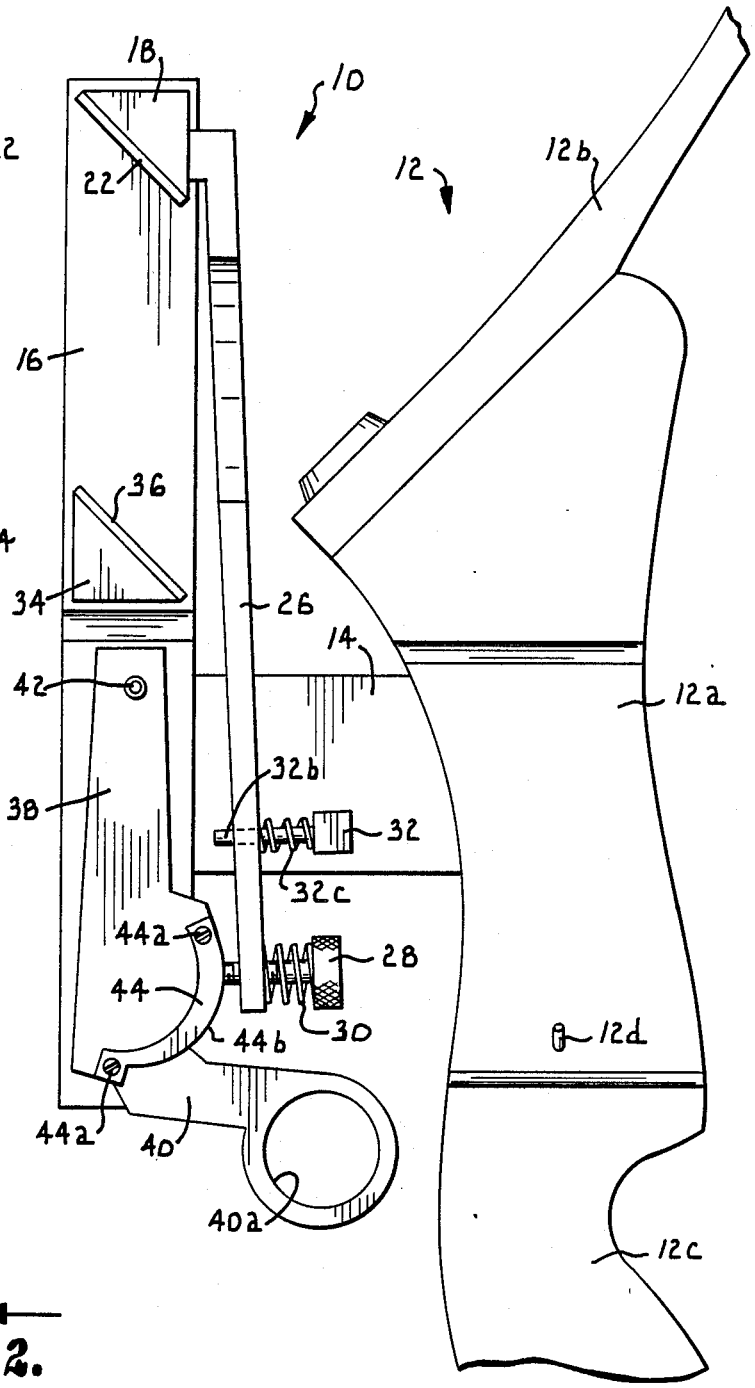
FIG. 2 is a left side elevation view of the bow sight taken along line 2—2 of FIG. 1 in the direction of the arrows.
Figures 3, 4, 5:
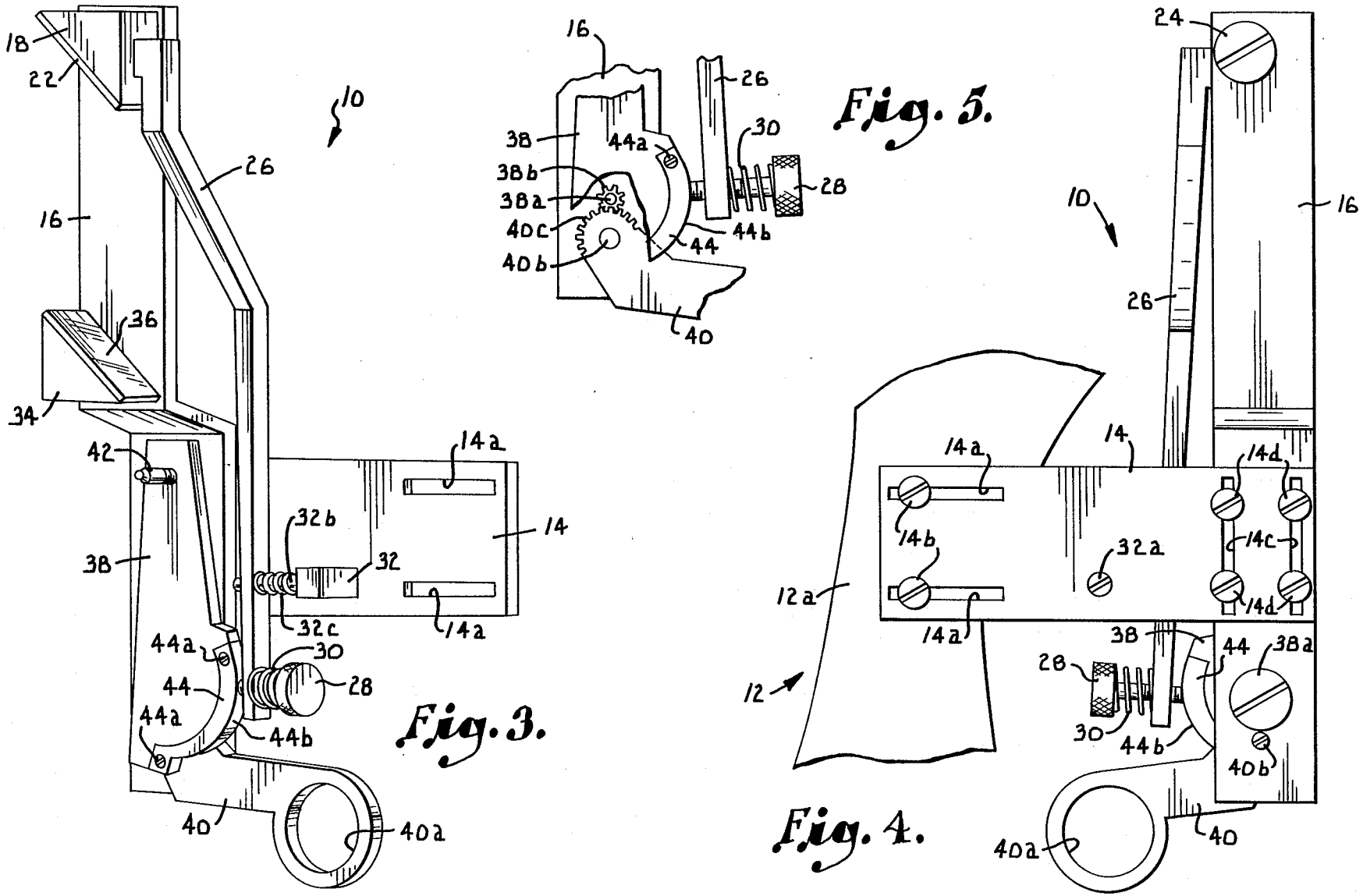
FIG. 3 is a perspective view of the bow sight.
FIG. 4 is a right side elevation view of the bow sight taken along line 4—4 of FIG. 1 in the direction of the arrows.
FIG. 5 is an enlarged fragmentary view of the cam adjustment mechanism of the bow sight as shown in FIG. 2 with portions thereof broken away to better illustrate the details of construction.

Referring to the drawings in greater detail, the bow sight of this invention is referenced generally with the numeral 10. The bow sight 10 is adapted to be mounted on a conventional archery bow, a fragmentary portion of which is shown in FIGS. 1, 2 and 4 and designated with the numeral 12. As those skilled in the art will readily understand, the archery bow consists of a riser 12*a* having limbs 12*b* connected thereto with a bow string strung between the outer ends of the limbs 12*b*. A grip region 12*c* for the archer's hand is typically formed as an integral part of the riser 12*a*. An arrow rest 12*d* is typically located above the grip region 12*c* to carry an arrow (not shown) to be propelled from the bow.

The bow sight 10 includes a horizontal frame plate 14 having spaced apart, elongated horizontal slots 14*a* near one end thereof. The horizontal slots 14*a* receive bow mounting screws 14*b* for adjustably securing the horizontal frame plate 14 to the bow riser 12*a* in order to project forwardly beyond the front of the bow. On the outer, forward end of the horizontal frame plate 14 are spaced apart, vertical slots 14*c* which receive a plurality of mounting screws 14*d* securing a vertical frame plate 16 to the outer end of the horizontal frame plate 14. Thus, the vertical frame plate 16 is oriented substantially perpendicular to the horizontal frame plate 14, but may be adjustably repositioned as desired.

Connected to the upper end of the vertical frame plate 16 is an upper mirror block 18 mounted by means of upper mirror screw 20 to permit limited pivotal movement of the upper mirror block 18 with respect to the vertical frame plate 16. An upper mirror 22 is adhesively secured to the upper mirror block 18 and, as best illustrated in FIG. 2, is oriented at roughly a 45° angle with the reflective surface of the upper mirror 22 facing substantially forwardly of the bow. Securely fixed to the upper mirror block 18 by a screw 24 is a mirror pivot arm 26 which extends downwardly throughout a major portion of the length of the vertical frame plate 16. The lowermost end of the mirror pivot arm 26 threadably receives the shank of a knurled adjustment knob 28. A helical spring 30 encircles the shank of the adjustment knob 28 to provide a tension force between the mirror pivot arm 26 and adjustment knob 28 to resist unintended movement between these members of the bow sight 10.

Rearwardly of the mirror pivot arm 26, a stop block 32 is secured by a screw 32*a* to the horizontal frame plate 14. Fixed on the stop block 32 is a pin 32*b* which extends forwardly therefrom to be slidably received within a hole (not shown) in the mirror pivot arm 26. A helical spring 32*c* is carried on the pin 32*b* and is positioned between the stop block 32 and the mirror pivot arm 26 to yieldably bias the pivot arm 26 in a direction away from the stop block 32.

Positioned beneath the upper mirror block 18 and spaced apart therefrom, a lower mirror block 34 is secured to the vertical frame plate 16. A fixed lower mirror 36 is adhesively secured to the lower mirror block 34 and is oriented at substantially a 45° angle with the reflective surface of the lower mirror 36 directed substantially toward the rear of the archery bow 12. The lower mirror block 34 and the associated lower mirror 36 are so positioned on the vertical frame plate 16 as to be in substantial alignment with the archer's eye when the bow 12 is held in a normal shooting position. Thus, the upper mirror 22 and lower mirror 36 are arranged in a periscope type relationship whereby the target image received by the upper mirror 22 is reflected to the lower mirror 36 which, in turn, reflects the target image to the archer's eye.

Pivotally pinned to the lower portion of the vertical frame plate 16 is a sight mounting plate 38. The sight mounting plate 38 is connected to the vertical frame plate 16 by mounting screw 38*a* for limited rotational movement of the sight mounting plate 38 with respect to the vertical frame plate 16. Also pinned to the vertical frame plate 16 for limited rotational movement is a sight actuating lever 40 having a rearwardly extending arm terminating in a finger engaging aperture 40*a*.

As best illustrated in FIG. 5, the sight actuating lever 40 is pinned to the vertical frame member 16 by means of a screw 40*b* spaced apart and beneath the screw 38*a* connecting the sight mounting plate 38 to the vertical frame plate 16. A plurality of gear teeth 40*c* are formed on the radius end of the actuating lever 40, as illustrated in FIG. 5, to mesh with a sprocket wheel 38*b* fixed to the inside surface of the sight mounting plate 38. Thus configured, a small rotational displacement of the sight actuating lever 40 about pivot pin 40*b* imparts, through the meshed engagement of gear teeth 40*c* with sprocket wheel 38*b*, a larger rotational displacement of the sight mounting plate 38 about pivot pin 38*a*.

Mounted near the upper end of the sight mounting plate 38 is a sight pin or bead 42 which, as shown in FIG. 1, projects outwardly and above the arrow rest 12*d* of the archery bow 12. The sight pin or bead 42 serves as an aiming point the archer can hold on the target when preparing to shoot an arrow.

Securely, but removably, fixed to the sight mounting plate 38 by screws 44*a* is a programmed cam 44 having a preselected contour surface 44*b*. The contour surface 44*b* of the programmed cam 44 is engaged by the innermost end of the knurled adjustment knob 28. Accordingly, rotational displacement of the sight mounting plate 38 through the sight actuating lever 40 causes the programmed cam 44 acting through the adjustment knob 28 and mirror pivot arm 26 to moderately vary the reflective angle of the upper mirror 22.

The actual shape of the contour surface 44*b* of the programmed cam 44 is determined in accordance with the recognized laws of physics and can be readily estimated with the aid of conventional mathematical expressions describing projectile trajectory behavior. In other words, the exact shape of the programmed cam 44 may be experimentally determined or may be empirically determined with reference to the characteristics of the archery equipment being utilized. Those skilled in the study of projectile trajectories will recognize that the primary factors to be considered are the initial speed of the arrow released from the bow, the mass of the arrow, and the air resistance of the arrow in flight.

In operation, the bow sight 10 is mounted to the archery bow 12 with mounting screws **14*b* through the horizontal frame plate 14. The vertical frame plate 16 may be adjustably repositioned on the horizontal frame plate 14 to a location which will enable the archer to consistently place arrows in a target at a short distance, such as 5 yards, when the sight pin 42 is moved to its uppermost position (since this is the position that will correspond to the 5 yard position programmed into the cam contour surface 44*b***) and the archer's best shooting technique is employed.

The archer then chooses a programmed cam 44 based on the characteristics of the archer's particular equipment. This may require trial and error selection. Alternatively, a good estimation can be determined by knowing the speed at which the archer's bow propels an arrow. The arrow speed can be measured by a chronograph. When the appropriate programmed cam 44 has been selected, it is mounted on the sight mounting plate 38 with screws **44*a***.

After the proper programmed cam 44 is installed on the sight mounting plate 38, several arrows should be delivered to the target at 5 yards with the sight pin 42 in its uppermost position. Slight adjustment of the vertical frame plate 16 with respect to the horizontal frame plate 14 may be achieved by the mounting screws **14*b***.

When the bow sight 10 is properly adjusted to a 5 yard target as described with the sight pin 42 in the uppermost position, the range finder function of the bow sight 10 may then be calibrated in the following manner. By holding the bow 12 in the preferred shooting position, the archer will see a reflected image of the target from the lower mirror 36 which will be positioned adjacent the real target image. At this point, the sight pin 42 should still be in its uppermost position and the target should be at exactly 5 yards (since this is the distance previously selected for the sight-in and calibration procedure).

The knurled adjustment knob may then be manipulated until both the real target image and the reflected target image appear to be in exact vertical alignment. When the foregoing procedure has been completed, the bow sight 10 is correctly adjusted and will accurately reposition the pin sight 42 for the correct trajectory of any distance within the capabilities of the archery equipment being used.

After the bow sight 10 has been properly adjusted in accordance with the previously describe method, it may be used in the following manner to aid the archer in shooting at a target at an unknown distance. With the archery bow 12 held in a normal shooting position the lower mirror 36 will be adjacent the actual image of the target. The archer operates the sight actuating lever 40 until the reflected image of the target from lower mirror 36 appears to be in exact vertical alignment with the actual image of the target. When this occurs, the sight pin 42 carried on the sight mounting plate 38 will have been pivotally shifted to the appropriate position to be held on the target for delivering the arrow with the required trajectory to the target.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A range finding sight for an archery bow to aid in accurately delivering an arrow to a target at unknown distance, said sight comprising frame means adjustably secured to said archery bow;

a movable, target image mirror assembly pinned to said frame means for limited pivotal movement with respect thereto;

a fixed reflected image mirror attached to said frame means in spaced apart relationship from said target image mirror assembly to establish a periscope-like reflected viewing line to a distant target;

an aiming point movably connected to said frame means; and cam linkage means carried on said frame means interconnecting said aiming point and said target image mirror assembly whereby movement of said aiming point provides a predetermined corresponding movement of said target image mirror assembly, such that when the actual target image and a reflected target image from said reflected image mirror are perceived to be in vertical alignment, said aiming point will be positioned to be held on the target for delivering said arrow with the required trajectory to the target.

2. The range finding sight as in claim 1 including a sight mounting member pivotally pinned to frame means to carry said aiming point for limited pivotal movement with respect to said frame means.

3. The range finding sight as in claim 2, said cam linkage means having a contoured cam surface connected to said sight mounting member, and said target image mirror assembly including a reflective target image mirror and a lever arm having first and second ends thereof, said first end of said lever arm being secured to said target image mirror and said second end of said lever arm yieldably engaging said contoured cam surface connected to said sight mounting member, whereby pivotal movement of said sight mounting member results in a corresponding movement as determined by said contoured cam surface through said lever arm of said target image mirror to vary the reflective angle thereof and the corresponding reflected image of a distant target.

4. The range finding sight as in claim 3, the contour configuration of said cam surface being estimated with the aid of conventional mathematical expressions describing projectile trajectory behavior.

5. The range finding sight as in claim 3, said second end of said lever arm carrying a manually adjustable knob member having an outer end slidably engaging said cam surface and adapted to adjustable extend and retract from said lever arm to vary the engaging relationship between said lever arm and said cam surface.

6. The range finding sight as in claim 3 further including spring biasing means connected to said frame means and engaging said lever arm to yieldably bias said lever arm to engagement with said cam surface.

7. The range finding sight as in claim 3 further including a manually manipulatable lever connected to said frame means and having linkage means connected to said sight mounting member whereby movement of said manipulatable lever results in corresponding pivotal movement of said sight mounting member.

8. The range finding sight as in claim 3 further including a manually manipulatable lever pivotally pinned to said frame means and having linkage means connected to said sight mounting member whereby pivotal movement of said manipulatable lever results in corresponding pivotal movement of said sight mounting member.

9. The range finding sight as in claim 8, said linkage means of said manipulatable lever comprises a gear linkage between said lever and said sight mounting member whereby a specific angular displacement of said lever results in a correspondingly greater angular displacement of said sight mounting member.

* * * * *